US009173503B2

(12) United States Patent
Mountz et al.

(10) Patent No.: US 9,173,503 B2
(45) Date of Patent: Nov. 3, 2015

(54) INFANT SWING APPARATUS

(71) Applicant: Wonderland Nurserygoods Company Limited, Central Hong Kong (HK)

(72) Inventors: Jonathan K. Mountz, Geigergown, PA (US); Peter R. Tuckey, Leola, PA (US)

(73) Assignee: Wonderland Nurserygoods Company Limited, Hong Kong (HK)

( * ) Notice: Subject to any disclaimer, the term of this patent is extended or adjusted under 35 U.S.C. 154(b) by 0 days.

(21) Appl. No.: 14/220,610

(22) Filed: Mar. 20, 2014

(65) Prior Publication Data

US 2014/0287846 A1 Sep. 25, 2014

Related U.S. Application Data

(60) Provisional application No. 61/852,784, filed on Mar. 21, 2013, provisional application No. 61/855,317, filed on May 13, 2013.

(51) Int. Cl.

| | |
|---|---|
| ***A63G 9/14*** | (2006.01) |
| ***A47D 13/10*** | (2006.01) |
| ***A47D 9/02*** | (2006.01) |
| *A47D 13/02* | (2006.01) |

(52) U.S. Cl.

CPC ..... *A47D 13/105* (2013.01); *A47D 9/02* (2013.01)

(58) Field of Classification Search

CPC ..... A63G 9/00; A63G 9/14; A63G 9/16; A63G 13/00; A63G 13/02; A63G 19/00; A63G 19/20; A47D 13/01; A47D 13/02; A47D 13/10; A47C 3/00; A47C 3/02; A47C 3/0255

USPC ..... 472/118–125; 297/273, 277; 5/101, 5/103, 108, 109

See application file for complete search history.

(56) References Cited

U.S. PATENT DOCUMENTS

| | | | | |
|---|---|---|---|---|
| 4,254,990 | A * | 3/1981 | Kelley | 297/273 |
| 4,805,902 | A | 2/1989 | Casagrande | |
| 5,803,817 | A | 9/1998 | Stern | |
| 6,544,128 | B1 * | 4/2003 | Yang | 472/119 |
| 6,578,212 | B2 | 6/2003 | Roudebush | |

(Continued)

FOREIGN PATENT DOCUMENTS

| | | | |
|---|---|---|---|
| CN | 101756561 | A | 6/2010 |
| CN | 202681300 | U | 1/2013 |
| CN | 203106466 | U | 8/2013 |

OTHER PUBLICATIONS

Official Action from Taiwan Patent Application No. 103110518 dated May 20, 2015.

(Continued)

*Primary Examiner* — Kien Nguyen

(74) *Attorney, Agent, or Firm* — David I. Roche; Baker & McKenzie LLP

(57) ABSTRACT

An infant swing apparatus includes a base frame, a rigid support column rising from the base frame and having a front and a rear, and a swing arm arranged at the front of the support column and having a first end portion and a second end portion. The support column has an upper portion that leans toward the rear of the support column. The first end portion of the swing arm is connected with a seat support, and the second end portion is pivotally connected with the upper portion of the support column about a pivot axis that is located above the seat support.

33 Claims, 8 Drawing Sheets

(56) References Cited

U.S. PATENT DOCUMENTS

| | | | | |
|---|---|---|---|---|
| 7,252,594 | B2 | 8/2007 | Armbruster et al. | |
| 7,789,762 | B2 * | 9/2010 | Greger et al. | 472/119 |
| 8,313,390 | B2 | 11/2012 | Lu | |
| 2002/0052245 | A1 | 5/2002 | Flannery et al. | |
| 2009/0126105 | A1 * | 5/2009 | Chen et al. | 5/109 |
| 2010/0201171 | A1 | 8/2010 | Velderman et al. | |
| 2011/0230272 | A1 | 9/2011 | Pyrce et al. | |
| 2012/0066833 | A1 | 3/2012 | Sclare et al. | |
| 2013/0026805 | A1 | 1/2013 | Sclare et al. | |

OTHER PUBLICATIONS

Office Action of the AU Patent Application No. 2014201661 dated Jun. 5, 2015.

* cited by examiner

INFANT SWING APPARATUS

CROSS-REFERENCE TO RELATED APPLICATIONS

This application claims priority to U.S. Provisional Patent Application No. 61/852,784 filed on Mar. 21, 2013, and to U.S. Provisional Patent Application No. 61/855,317 filed on May 13, 2013, both of which are incorporated herein by reference.

BACKGROUND

1. Field of the Invention

The present invention relates to infant swing apparatuses.

2. Description of the Related Art

Swing apparatuses can be used by parents to help calming or entertaining a child. An infant swing apparatus typically has a large base, and a swing arm that can travel in a pendulum motion. Unfortunately, most swing apparatuses currently available on the market occupy a significant space. Owing to a large size, they are not convenient to move from one room to another in a house.

Therefore, there is a need for an infant swing apparatus that can be more compact, is easy to operate, and address at least the foregoing issues.

SUMMARY

The present application describes an infant swing apparatus. In one embodiment, the infant swing apparatus includes a base frame, a rigid support column rising from the base frame and having a front and a rear, and a swing arm arranged at the front of the support column and having a first end portion and a second end portion. The support column has an upper portion that leans toward the rear of the support column. The first end portion of the swing arm is connected with a seat support, and the second end portion is pivotally connected with the upper portion of the support column about a pivot axis that is located above the seat support.

In another embodiment, the infant swing apparatus includes a base frame, a rigid support column rising from the base frame and having a front and a rear, and a swing arm arranged at the front of the support column and having a first end portion and a second end portion. The first end portion of the swing arm is connected with a seat support, and the second end portion of the swing arm is pivotally connected with the support column about a pivot axis that slopes downward toward the rear of the support column.

DETAILED DESCRIPTION OF THE EMBODIMENTS

Figure 1:
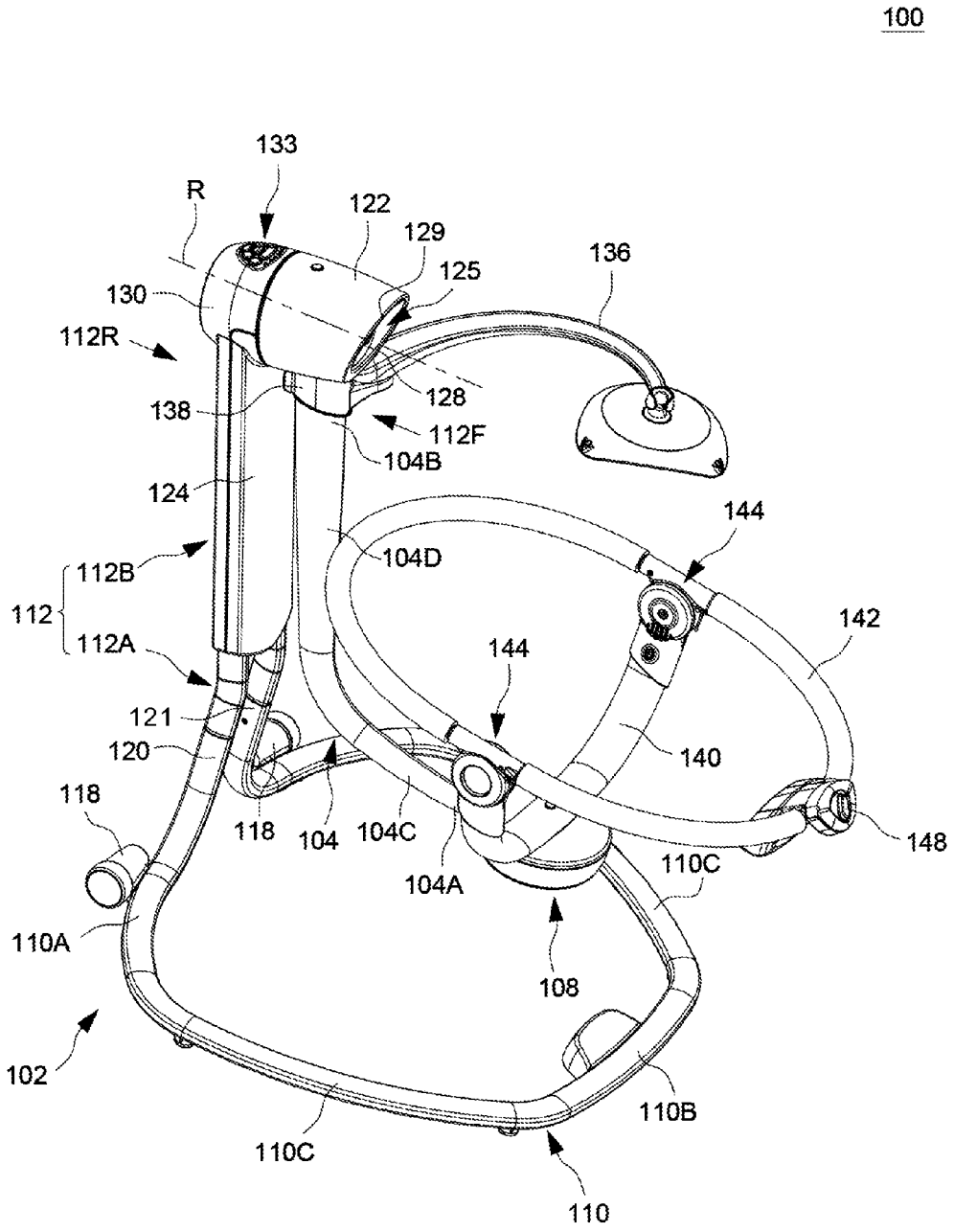
FIG. 1 is a perspective view illustrating an embodiment of an infant swing apparatus.
Figure 2:
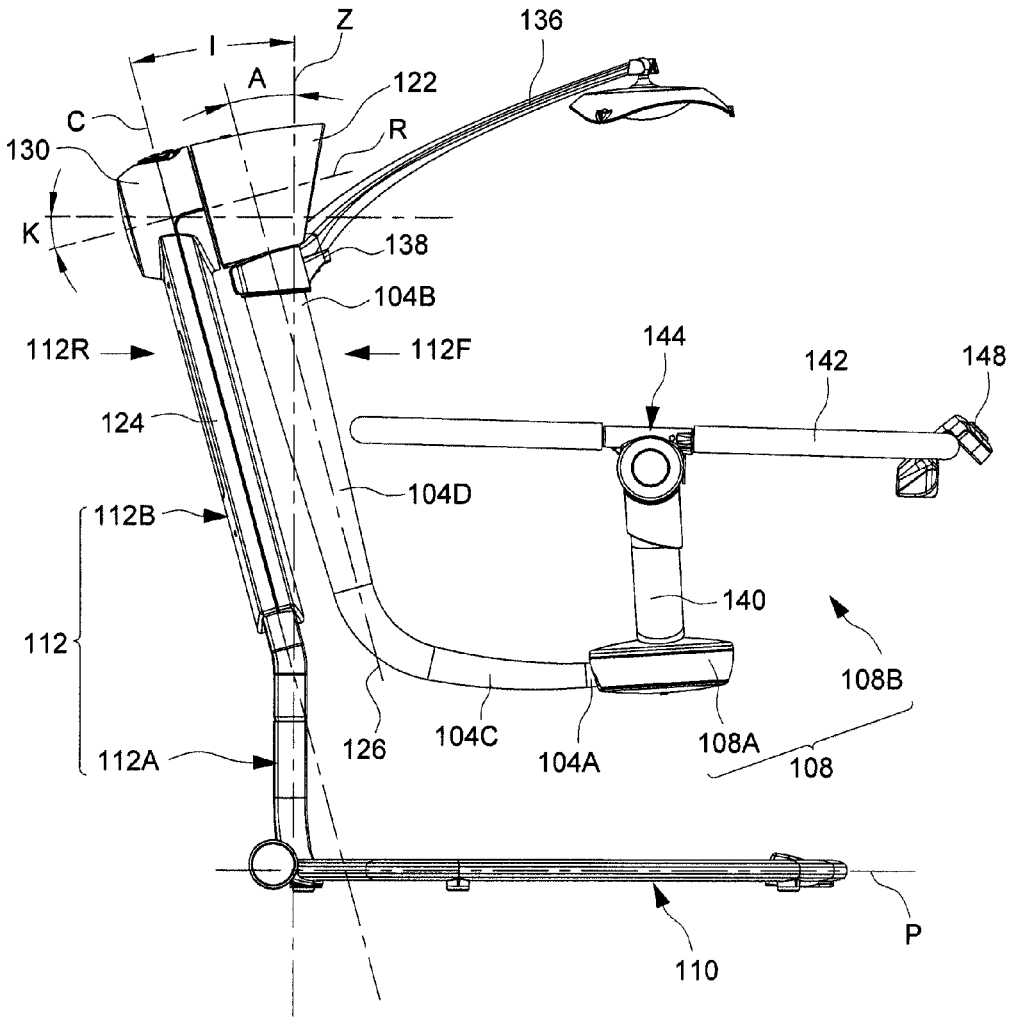
FIG. 2 is a side view of the infant swing apparatus shown in FIG. 1.
Figure 3:
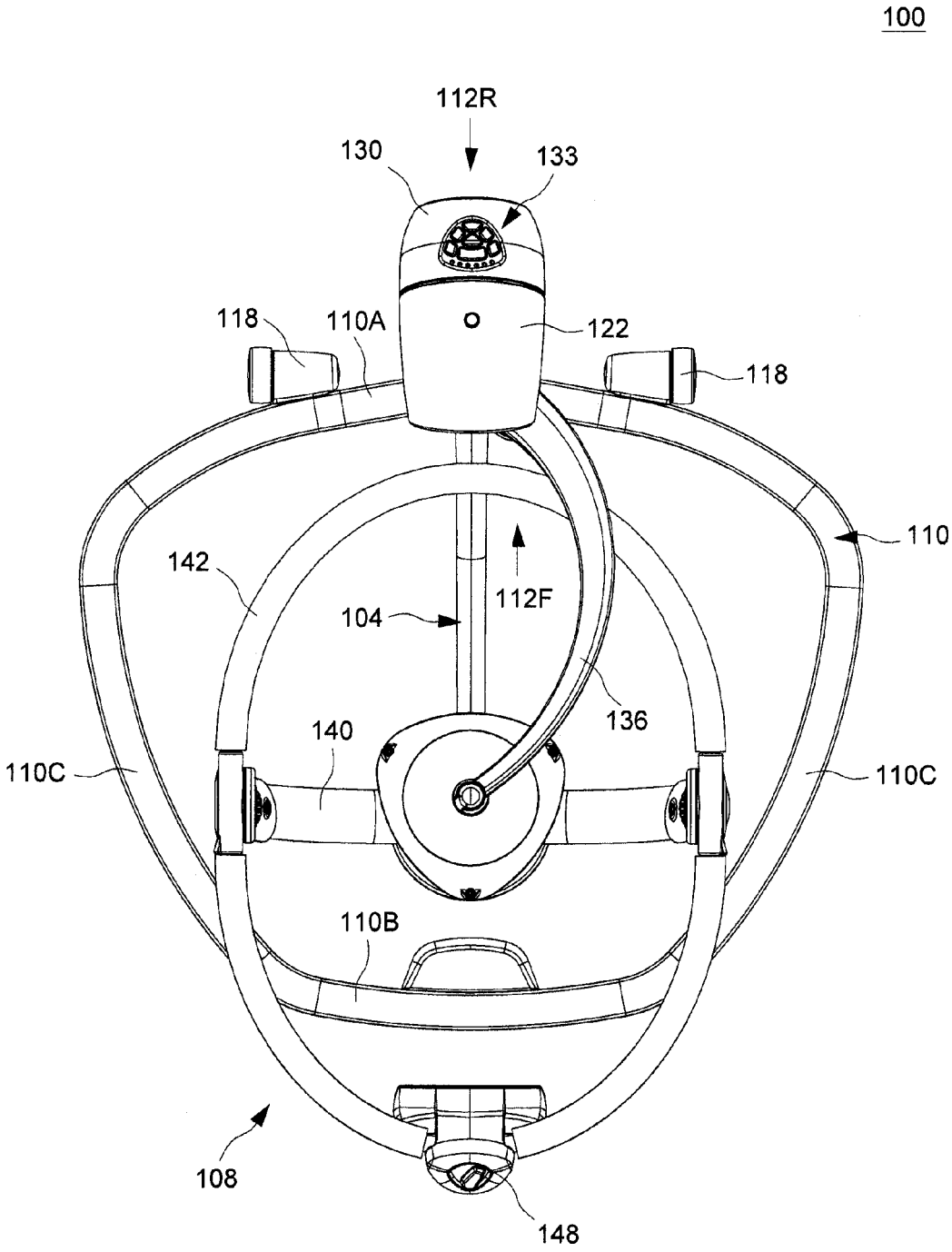
FIG. 3 is a top view of the infant swing apparatus shown in FIG. 1.

FIG. 1 is a schematic view illustrating an embodiment of an infant swing apparatus 100, FIG. 2 is a side view of the infant swing apparatus 100, and FIG. 3 is a top view of the infant swing apparatus 100. The infant swing apparatus 100 can include a support frame 102, a swing arm 104 and a seat support 108. The support frame 102 can include a base frame 110 extending along a horizontal plane, and a rigid support column 112 rising upward from the base frame 110 and having a front 112F and a rear 112R. The swing arm 104 can be pivotally connected with the support column 112 at the front 112F thereof and hold the seat support 108 above the base frame 110.

The base frame 110 can be formed by the assembly of one or more tube segments, and can form an enlarged loop that defines a support plane P. In one embodiment, the base frame 110 can have a rear edge 110A, a front edge 110B, and a left and a right side segment 110C respectively connected with the rear and front edges 110A and 110B. The rear edge 110A can be longer than the front edge 110B, and the left and right side segments 110C can respectively converge from the rear edge 110A toward the front edge 110B. The enlarged area of the base frame 110 can provide stable resting support on a floor and below the seat support 108. Moreover, the rear edge 110A of the base frame 110 can be assembled with multiple wheel assemblies 118 that may facilitate transportation of the infant swing apparatus 100.

It will be appreciated that the illustrated shape of the base frame 110 is only one possible example, and other shapes may be implemented.

The support column 112 can have a lower portion 112A and an upper portion 112B connected with each other. In one embodiment, the lower and upper portions 112A and 112B can include two parallel assemblies of tube segments 120 and 121 that are continuously connected with a tubular assembly of the base frame 110. A housing 124 can enclose an upper region of the two assemblies of tube segments 120 and 121 corresponding to the upper portion 112B of the support column 112.

The lower portion 112A can be downwardly affixed with the base frame 110, and can be connected upwardly with the upper portion 112B. The lower portion 112A can have an elongated and substantially straight shape, and can extend vertically and perpendicular to the support plane P of the base frame 110.

The upper portion 112B can be downwardly connected with the lower portion 112A, and can be upwardly assembled with the swing arm 104 about a pivot axis R located above the seat support 108. The upper portion 112B can have an elongated and substantially straight shape extending along an axis C, and can lean toward the rear 112R of the support column 112. The inclination angle I at which the upper portion 112B of the support column 112 is tilted relative to a vertical axis Z can be between about 5 and 30 degrees. Preferably, the inclination angle I can be around 15 degrees. The inclination angle I can be such that a projection of the upper portion 112B on the support plane P of the base frame 110 can extend rearward past the rear edge 110A of the base frame 110.

The rearward inclination of the support column 112 can displace a weight load distribution toward a vertical axis of support defined by the lower portion 112A. As a result, compared to a support column that rises uniformly vertical, the rearward inclination of the support column 112 can allow to reduce the size of the base frame 110. For example, as shown in FIGS. 2 and 3, the base frame 110 can be reduced such that a front portion of the seat support 108 when projected on the support plane P can extend forward past the front edge 110B of the base frame 110.

Referring again to FIGS. 1-3, the swing arm 104 can be arranged at the front 112F of the support column 112, and can be formed as an assembly of tube segments. More specifically, the swing arm 104 can have a lower end portion 104A connected with the seat support 108, an upper end portion 104B pivotally connected with the a top portion of the support column 112, and two segments 104C and 104D connected with each other and extending between the lower and upper end portions 104A and 104B. The segment 104C can extend substantially horizontal, and can be affixed with the seat support 108 at the lower end portion 104A. The segment 104D can have an elongated shape, and can rise upward from the segment 104C along an axis 126 that is substantially parallel to the upper portion 112B of the support column 112 (in particular, the axis 126 of the segment 104D of the swing arm 104 can be substantially parallel to the axis C of the upper portion 112B of the support column 112). The angle A between the axis 126 of the segment 104D and the vertical axis Z can be substantially equal to the inclination angle I of the upper portion 112B.

Figure 5:
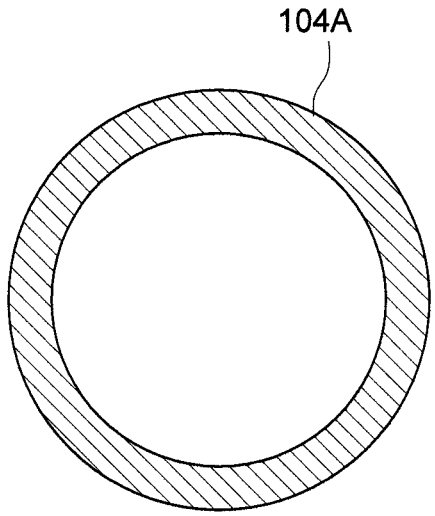
FIG. 5 is a cross-sectional view illustrating the section of a first end portion of a swing arm in the infant swing apparatus.
Figure 6:
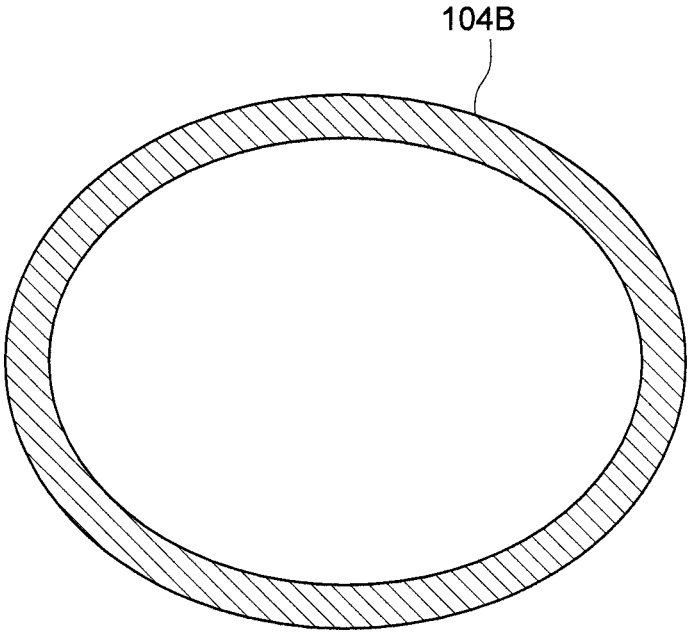
FIG. 6 is a cross-sectional view illustrating the section of a second end portion of the swing arm in the infant swing apparatus.

In one embodiment, the swing arm 104 can have a tapered shape that progressively enlarges along the length of the swing arm 104 from the lower end portion 104A to the upper end portion 104B. For example, the lower end portion 104A can have a circular section as shown in FIG. 5, the upper end portion 104B can have an elliptical section as shown in FIG. 6, and the swing arm 104 can have a varying section that progressively enlarges from the circular section of the lower end portion 104A to the elliptical section of the upper end portion 104B. The construction using a tapered shape and varying section can allow the swing arm 104 to have greater strength for torsional loading, and can reduce deflection of the overall frame structure.

A hub housing 122 can be affixed with the upper end portion 104B of the swing arm 104. The hub housing 122 can have a front formed with a recess 125 to define a carry handle 129 for facilitating the portability of the infant swing apparatus 100. Moreover, the front of the hub housing 122 can also be assembled with a lamp 128 that is arranged adjacent to the carry handle 129. The lamp 128 can cast a gentle and ambient light over the child placed on the seat support 108.

Figure 4:
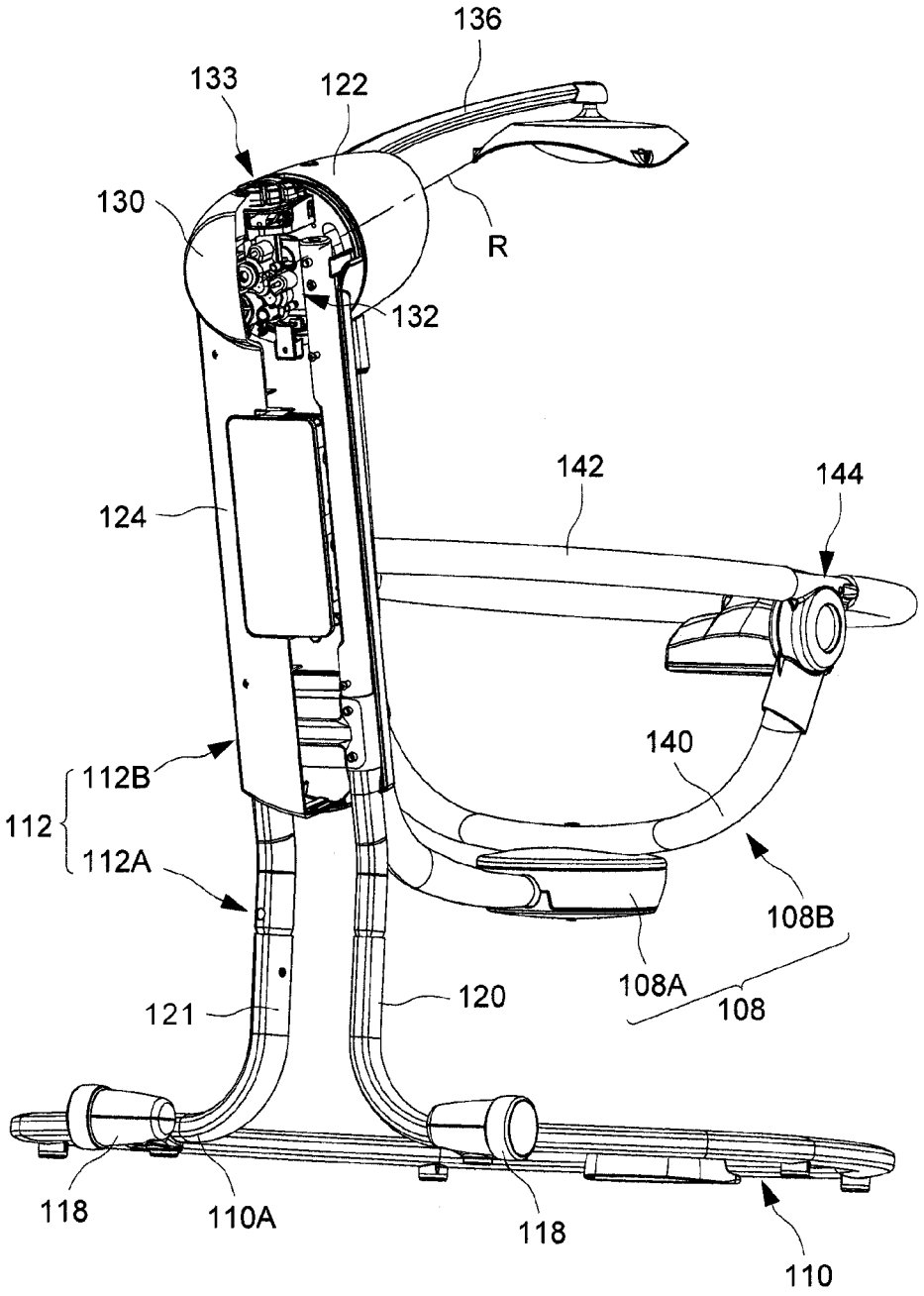
FIG. 4 is a schematic view illustrating the assembly of a motorized driving mechanism in the infant swing apparatus.

Referring to FIG. 4, a top portion of the support column 112 can be assembled with a housing portion 130 that can enclose a motorized driving mechanism 132. The hub housing 122 and the upper end portion 104B of the swing arm 104 can be pivotally assembled with the top portion of the support column 112, and can be coupled with the driving mechanism 132. A control interface 133 comprised of multiple buttons may be arranged on the housing portion 130 for controlling the operation of the driving mechanism 132. Accordingly, the driving mechanism 132 can be operable to cause rotational displacement of the swing arm 104 about the pivot axis R so as to impart a pendulum motion to the seat support 108.

In one embodiment, the pivot axis R of the swing arm 104 can be inclined at an angle K relative to a horizontal axis, and can slope downward toward the rear 112R of the support column 112 and upward toward the front 112F of the support column 112. The angle K can be between about 5 and 30 degrees, e.g., 15 degrees. In one embodiment, the angle K can also be substantially equal to the angle I between the upper portion 112B of the support column 112 and the vertical axis Z. This inclination of the pivot axis R can lower the frequency of the swing arm 104 compared to a horizontal pivot axis. Accordingly, the length of the swing arm 104 may be shortened for a more compact volume of the infant swing apparatus 100 without increasing the swing frequency.

It will be appreciated that certain embodiments may provide an infant swing apparatus in which the pivot axis R of the swing arm 104 is inclined whereas the support column 112 extends substantially vertical. While the inclination of the pivot axis R may provide certain advantages as described previously, other embodiments of the infant swing apparatus 100 may also be implemented with the support column 112 leaning rearward whereas the pivot axis R is horizontal and parallel to a floor.

Referring again to FIGS. 1-4, a toy holding bar 136 may be removably assembled with the swing arm 104 adjacent to the hub housing 122. The toy holding bar 136 may be pivotally connected with a C-shaped clip 138 that can detachably fasten with the swing arm 104. The toy holding bar 136 can be pushed aside or completely removed for better access to the seat support 108.

The seat support 108 can include a lower part 108A connected with the swing arm 104, and an upper part 108B for receiving a child. The lower part 108A of the seat support 108 can be affixed with the lower end portion 104A of the swing arm 104, and the upper part 108B can be pivotally assembled with the lower part 108A. Accordingly, the upper part 108B can rotate about a vertical axis relative to the lower part 108A to adjust the orientation of the seat support 108.

In one embodiment, the upper part 108B of the seat support 108 can include, for example, a U-shaped support arm 140, and a seat frame 142 of an elliptical shape pivotally connected with the support arm 140 via hinges 144. The seat frame 142 can be rotated about a horizontal pivot axis relative to the support arm 140 to recline the seat frame 142. A vibration unit 148 may also be installed on the seat frame 142 for imparting vibration to the seat support 108.

Figure 7:
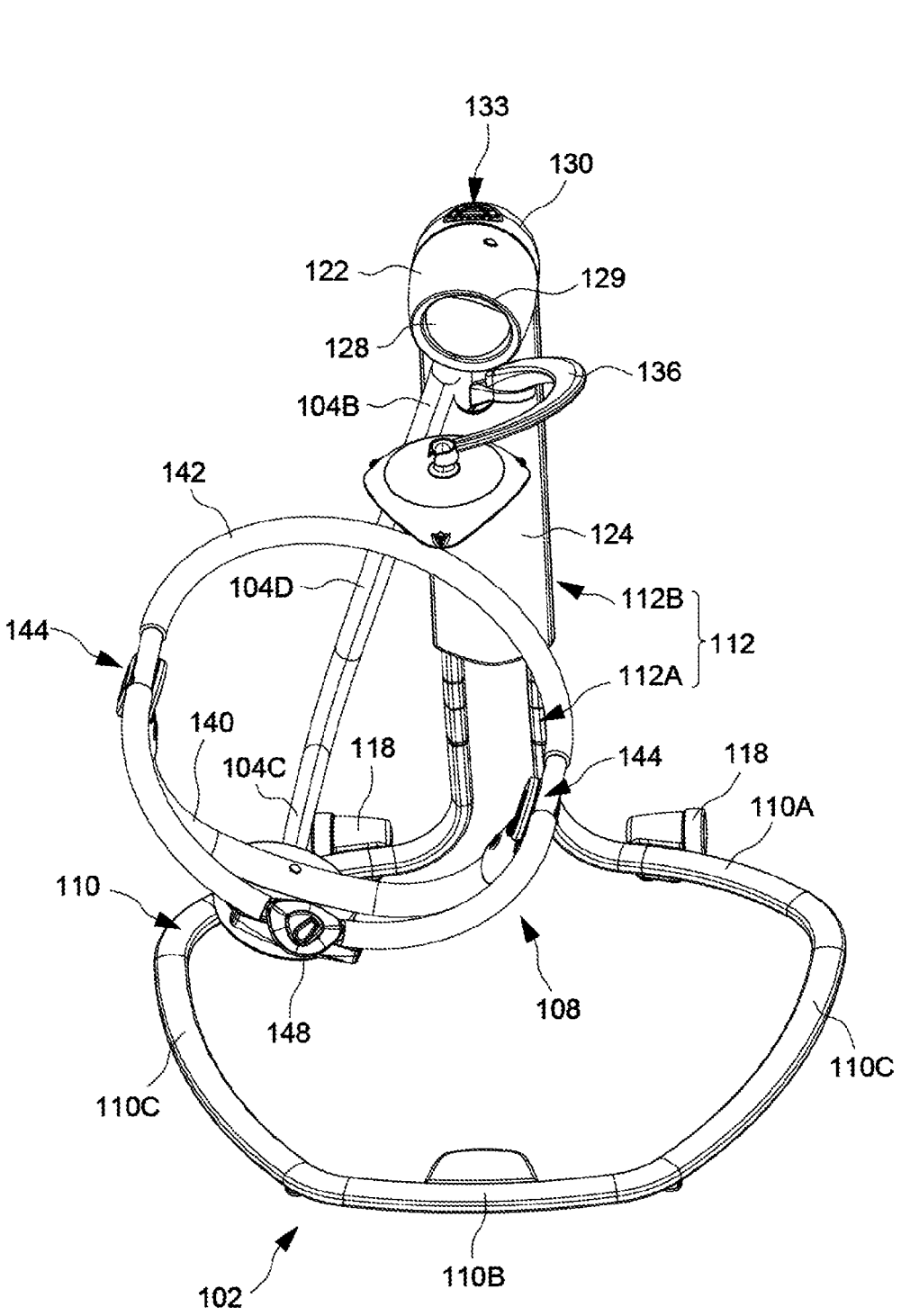
FIGS. 7 and 8 are schematic views illustrating exemplary swing motion performed by the infant swing apparatus.
Figure 8:
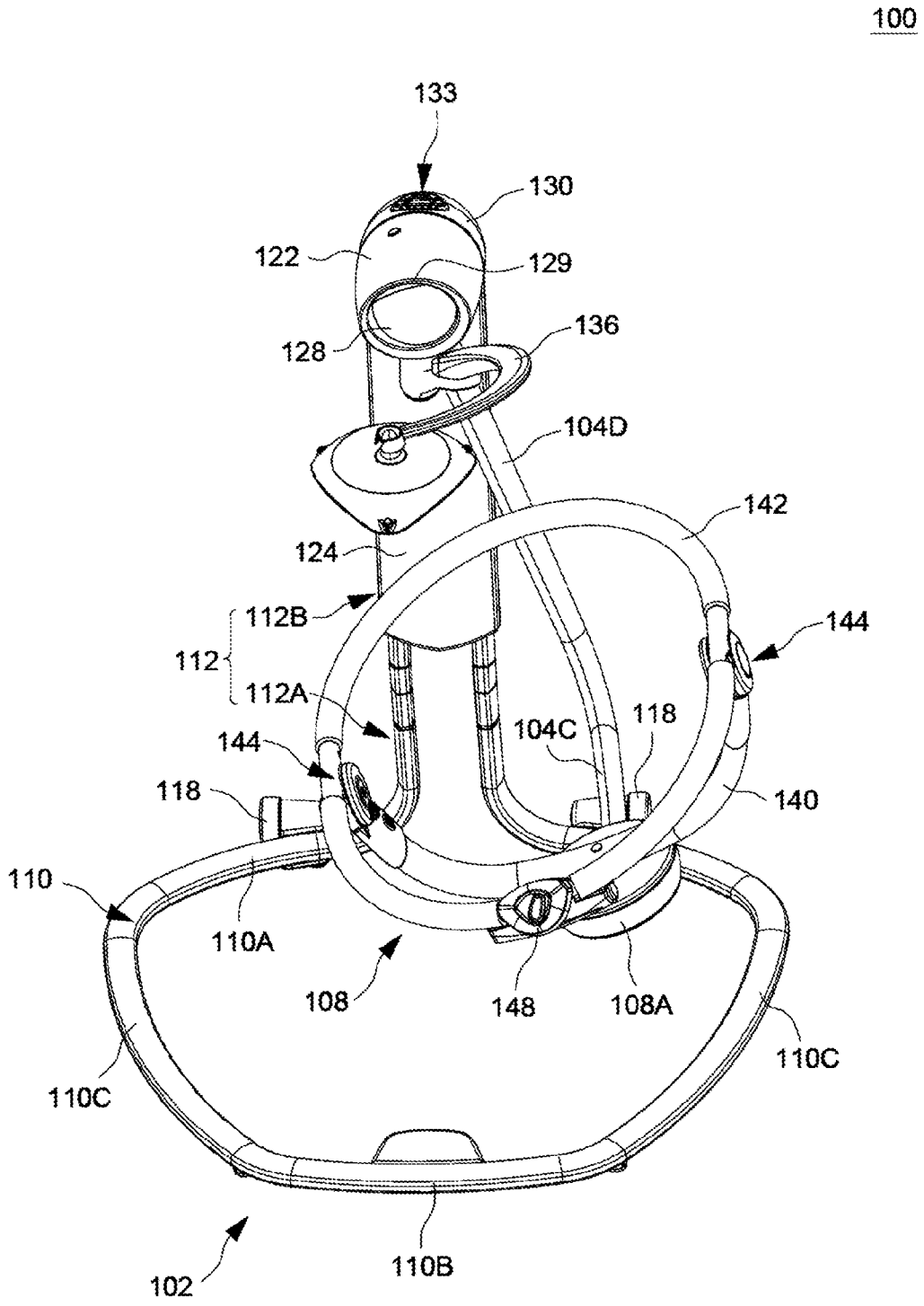

FIGS. 7 and 8 are schematic views illustrating exemplary pendulum motion performed by the infant swing apparatus 100. The swing arm 104 can swing to a left and a right side of the support column 112 to impart a pendulum motion to the seat support 108. The toy holding bar 136 can move along with the oscillating swing arm 104. This pendulum motion can swing the seat support 108 sideways (as shown in FIGS. 7 and 8) or back and forth (not shown) depending on the orientation of the seat support 108.

Figure 9:
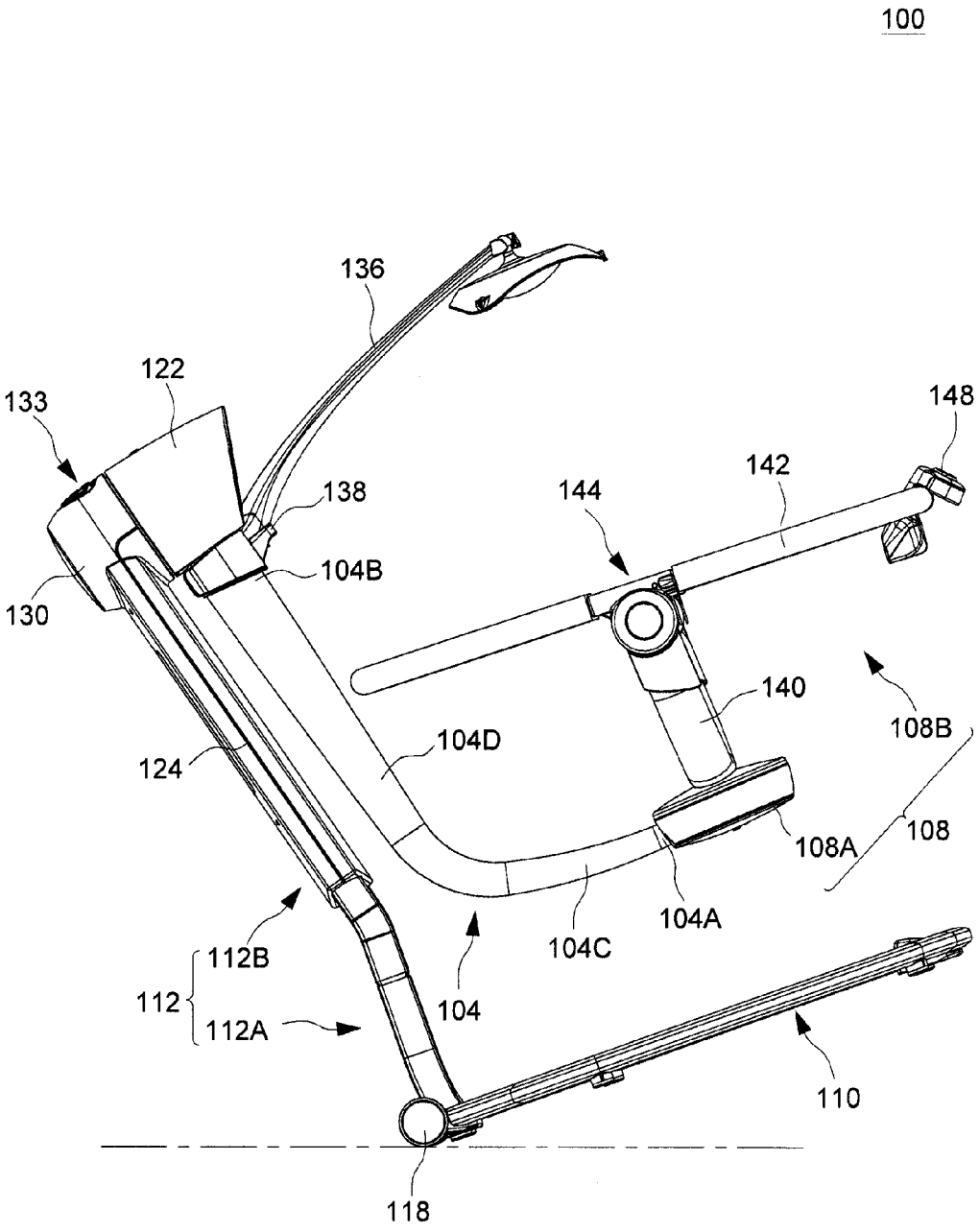
FIG. 9 is a schematic view illustrating exemplary operation for transporting the infant swing apparatus.

In conjunction with FIG. 1, FIG. 9 is a schematic view illustrating exemplary operation for transporting the infant swing apparatus 100. A caregiver can grasp the carry handle 129 to incline the infant swing apparatus 100 toward the rear 112R so that the wheel assemblies 118 are in effective rolling contact against the floor. The infant swing apparatus 100 then can be dragged or pushed with little effort.

Alternatively, the caregiver may also grasp the carry handle 129 to lift the infant swing apparatus 100 above the floor, and then transport it without contact of the base frame 110 with the floor.

Advantages of the structures described herein include the ability to provide an infant swing apparatus that is more compact in size, have better portability and is easy to use.

Realizations of the infant swing apparatus have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant swing apparatus comprising:

a base frame for providing stable resting support on a floor, the base frame having a rear edge and a support plane, the support plane being substantially horizontal when the base frame rests on a floor;

a support column connected with the base frame, the support column rising from the base frame and having a front and a rear, the support column having an upper portion that leans toward the rear of the support column, the upper portion extending rearward past the rear edge of the base frame; and a swing arm arranged at the front of the support column and having a first end portion and a second end portion, the first end portion being connected with a seat support, and the second end portion being pivotally connected with the upper portion of the support column about a pivot axis that is located above the seat support.

2. The infant swing apparatus according to claim 1, wherein the swing arm includes a first and a second segment connected with each other, the first segment being connected with the seat support at the first end portion, and the second segment extending along an axis substantially parallel to the upper portion of the support column.

3. The infant swing apparatus according to claim 1, wherein the upper portion of the support column is inclined at an angle from a vertical axis that is substantially between 5 and 30 degrees.

4. The infant swing apparatus according to claim 1, wherein the support column includes a lower portion that extends vertically and is respectively connected with the base frame and the upper portion.

5. The infant swing apparatus according to claim 1, wherein the upper portion has a substantially straight shape that extends upward to a top portion of the support column where the second end portion of the swing arm is pivotally connected.

6. The infant swing apparatus according to claim 1, wherein the pivot axis of the swing arm is inclined at an angle relative to a horizontal axis.

7. The infant swing apparatus according to claim 6, wherein the angle between the pivot axis and the horizontal axis is substantially equal to an inclined angle of the upper portion of the support column relative to a vertical axis.

8. The infant swing apparatus according to claim 1, wherein the swing arm has a varying section that enlarges toward the second end portion.

9. The infant swing apparatus according to claim 1, wherein the swing arm has a tapered shape between the first and second end portions.

10. The infant swing apparatus according to claim 1, wherein the first end portion of the swing arm has a circular section, and the second end portion of the swing arm has an elliptical section.

11. The infant swing apparatus according to claim 1, further including a driving mechanism operable to cause rotational displacement of the swing arm about the pivot axis, the driving mechanism being assembled with the upper portion of the support column.

12. The infant swing apparatus according to claim 1, wherein the rear edge of the base frame has a plurality of wheel assemblies, and the infant swing apparatus is inclinable toward the rear of the support column to cause the wheel assemblies to be in rolling contact with a floor surface.

13. The infant swing apparatus according to claim 1, wherein the second end portion of the swing arm is affixed with a hub housing, and the hub housing includes a carry handle.

14. The infant swing apparatus according to claim 13, wherein the hub housing is further assembled with a lamp arranged adjacent to the carry handle.

15. The infant swing apparatus according to claim 1, wherein the base frame further has a front edge, and a portion of the seat support projected on the support plane extends forward past the front edge of the base frame.

16. An infant swing apparatus comprising:

a base frame for providing stable resting support on a floor;

a support column connected with the base frame and having an upper portion, the support column rising upward from the base frame, and having a front and a rear, the upper portion having an elongated and substantially straight shape that leans toward the rear of the support column and terminates at a top of the support column; and a swing arm arranged at the front of the support column and having a first end portion and a second end portion, the first end portion being connected with a seat support, and the second end portion being pivotally connected with the support column about a pivot axis that slopes downward toward the rear of the support column.

17. The infant swing apparatus according to claim 16, wherein the support column further includes a lower portion connected with the upper portion, the lower portion extending substantially perpendicular to a support plane defined by the base frame.

18. The infant swing apparatus according to claim 1, wherein the swing arm includes a first and a second segment connected with each other, the first segment being connected with the seat support, at the first end portion and the second segment extending along an axis substantially parallel to the upper portion of the support column.

19. The infant swing apparatus according to claim 15, wherein the upper portion of the support column is inclined at an angle from a vertical axis that is between 5 and 30 degrees.

20. The infant swing apparatus according to claim 16, wherein an angle between the pivot axis and a horizontal axis is substantially equal to an inclined angle of the upper portion of the support column relative to a vertical axis.

21. The infant swing apparatus according to claim 16, wherein the swing arm has a varying section that enlarges toward the second end portion.

22. The infant swing apparatus according to claim 21, wherein the swing arm has a tapered shape between the first and second end portions.

23. The infant swing apparatus according to claim 21, wherein the first end portion of the swing arm has a circular section, and the second end portion of the swing arm has an elliptical section.

24. The infant swing apparatus according to claim 16, further including a driving mechanism operable to cause rotational displacement of the swing arm about the pivot axis, the driving mechanism being assembled with the upper portion of the support column.

25. The infant swing apparatus according to claim 16, wherein the base frame has a rear edge provided with a plurality of wheel assemblies, and the infant swing apparatus is inclinable toward the rear of the support column to cause the wheel assemblies to be in rolling contact with a floor surface.

26. The infant swing apparatus according to claim 16, wherein the second end portion of the swing arm is affixed with a hub housing, and the hub housing includes a carry handle.

27. The infant swing apparatus according to claim 26, wherein the hub housing is further assembled with a lamp arranged adjacent to the carry handle.

28. The infant swing apparatus according to claim 16, wherein the base frame has a rear edge and a support plane, the support plane being substantially horizontal when the base frame rests on a floor, and the upper portion extending rearward past the rear edge of the base frame.

29. The infant swing apparatus according to claim 28, wherein the base frame further has a front edge, and a portion of the seat support projected on the support plane extends forward past the front edge of the base frame.

30. An infant swing apparatus comprising:

a base frame for providing stable resting support on a floor;

a support column connected with the base frame and having an upper portion, the support column rising upward from the base frame and having a front and a rear, the upper portion having an elongated and substantially straight shape that leans toward the rear of the support column and terminates at a top of the support column; and a swing arm arranged at the front of the support column and having a first end portion and a second end portion located above the first end portion, the first end portion being connected with a seat support, and the second end portion being pivotally connected with the support column.

31. The infant swing apparatus according to claim 30, wherein the second end portion of the swing arm is pivotally connected with the support column about a pivot axis that slopes downward toward the rear of the support column, an angle between the pivot axis and a horizontal axis being substantially equal to an inclined angle of the upper portion of the support column relative to a vertical axis.

32. The infant swing apparatus according to claim 30, wherein the base frame has a rear edge and a support plane, the support plane being substantially horizontal when the base frame rests on a floor, and the upper portion extending rearward past the rear edge of the base frame.

33. The infant swing apparatus according to claim 32, wherein the base frame further has a front edge, and a portion of the seat support projected on the support plane extends forward past the front edge of the base frame.

* * * * *

UNITED STATES PATENT AND TRADEMARK OFFICE

CERTIFICATE OF CORRECTION

PATENT NO. : 9,173,503 B2
APPLICATION NO. : 14/220610
DATED : November 3, 2015
INVENTOR(S) : Jonathan K. Mountz et al.

It is certified that error appears in the above-identified patent and that said Letters Patent is hereby corrected as shown below:

IN THE CLAIMS

In Claim 18, line 1, change "claim 1" to – claim 15 –

Signed and Sealed this
Twenty-second Day of March, 2016

Michelle K. Lee

Michelle K. Lee
*Director of the United States Patent and Trademark Office*